US007458239B1

(12) United States Patent
Ma

(10) Patent No.: US 7,458,239 B1
(45) Date of Patent: Dec. 2, 2008

(54) COMBINATION-CHANGEABLE COMPLEX LOCK

(76) Inventor: Min-Tsung Ma, No. 299, Sec. 1, Park Rd., Chang Hua City, Chang Hua County 500 (TW)

( * ) Notice: Subject to any disclaimer, the term of this patent is extended or adjusted under 35 U.S.C. 154(b) by 0 days.

(21) Appl. No.: 11/840,746

(22) Filed: Aug. 17, 2007

(51) Int. Cl.
*E05B 37/00* (2006.01)

(52) U.S. Cl. ..... 70/21; 70/63; 70/71; 70/284; 70/285; 70/303 A; 70/312; 70/317; 70/329

(58) Field of Classification Search ..... 70/21, 70/38 A, 63, 69–71, 73, 74, 284, 285, DIG. 63, 70/DIG. 71, DIG. 2, DIG. 21, DIG. 22, DIG. 23, 70/DIG. 44, DIG. 75, 329, 332, 321–326, 70/312, 294, 301, 302, 303 R, 303 A, 309, 70/315–318
See application file for complete search history.

(56) References Cited

U.S. PATENT DOCUMENTS 488,518 A * 12/1892 Craig ..... 70/308
894,520 A * 7/1908 Mills ..... 70/303 R
900,437 A * 10/1908 Soley ..... 70/309
939,210 A * 11/1909 Brown et al. ..... 70/310
3,545,238 A * 12/1970 Feinberg et al. ..... 70/312
3,800,576 A * 4/1974 Barrett et al. ..... 70/302
3,979,932 A * 9/1976 Piche ..... 70/63
4,170,884 A * 10/1979 Calegan ..... 70/21
4,462,231 A * 7/1984 Zabel ..... 70/21
7,266,980 B1 * 9/2007 Ma ..... 70/69
2006/0213237 A1 * 9/2006 Yang ..... 70/63
2007/0214850 A1 * 9/2007 Ma ..... 70/284

* cited by examiner

*Primary Examiner*—Lloyd A Gall
(74) *Attorney, Agent, or Firm*—Browdy and Neimark, P.L.L.C.

(57) ABSTRACT

A combination-changeable complex lock includes a movable plate, a combination lock, and a sliding member. The combination lock is composed of two notched rotating discs, two gearwheels, and a combination-alteration control device. The combination-alteration control device is rotatable to separate the gearwheels from the notched rotating discs for allowing change of the set combination. The sliding member is controllable by the combination lock to engage or disengage the peripheral notches of notched rotating discs. When the combination lock is locked, the sliding member is disengaged from the notched rotating discs and forced against the movable plate to bias the movable plate.

9 Claims, 7 Drawing Sheets

COMBINATION-CHANGEABLE COMPLEX LOCK

BACKGROUND OF THE INVENTION

1. Field of the Invention

The present invention relates to locks and more particularly, to a combination-changeable complex lock.

2. Description of the Related Art

Conventional locks include two types, namely, the combination lock and the pin tumbler lock. If a combination lock is used, the user must enter the correct combination to open the lock. If a pin tumbler lock is used, the user must insert the key into the keyway of the pin tumbler lock and then rotate the plug of the pin tumbler lock with the key to the unlocking position so that the lock can be opened.

If a combination lock is used and the user forgets the correct combination of the combination lock, the user must deliver the lock to the distributor or a locksmith to open the combination lock. If a pin tumbler lock is used and the user does not have the key in hand, the user still fail to open the lock.

Further, a common combination lock usually does not provide a function of change of the combination, and thus the combination of the common combination lock is unchangeable. If the set combination of a combination lock is simple, a malicious person may crack the combination easily to open the combination lock. If the user writes down the combination on a memo or notebook to prevent forgetting the combination, a malicious person may steal the combination to open the lock, resulting in great loss of the user.

SUMMARY OF THE INVENTION

The present invention has been accomplished under the circumstances in view. It is the primary object of the present invention to provide a complex lock, whose combination is changeable, heightening the security. The secondary object of the present invention to provide a complex lock, which is the combination of a combination lock and a pin tumbler lock, allowing the user to optionally open the lock by a combination or a key.

To achieve the foregoing objects of the present invention, the complex lock includes a casing, a movable plate, a combination lock, and a sliding member. The movable plate is pivotally mounted to the casing. The combination lock is mounted to the casing, including a rotary knob having a shaft, two notched rotating discs sleeved onto the shaft of the rotary knob and each having a peripheral notch, two gearwheels (first and second) sleeved onto the shaft of the rotary knob and meshed with the notched rotating discs, a spring member sleeved onto the shaft of the rotary knob, and a combination-alteration control device rotatably sleeved onto the shaft of the rotary knob and stopped at one side of the second gearwheel opposite to the first gearwheel. The peripheral notches of the notched rotating discs are aligned with each other when the combination lock is unlocked or separated away from each other when the combination lock is locked. The sliding member is movable in the casing. The sliding member engages the peripheral notches of the notched rotating discs when the combination lock is unlocked, or is moved away from the peripheral notches of the notched rotating discs to push the movable plate when the combination lock is locked.

DETAILED DESCRIPTION OF THE INVENTION

Figure 1:
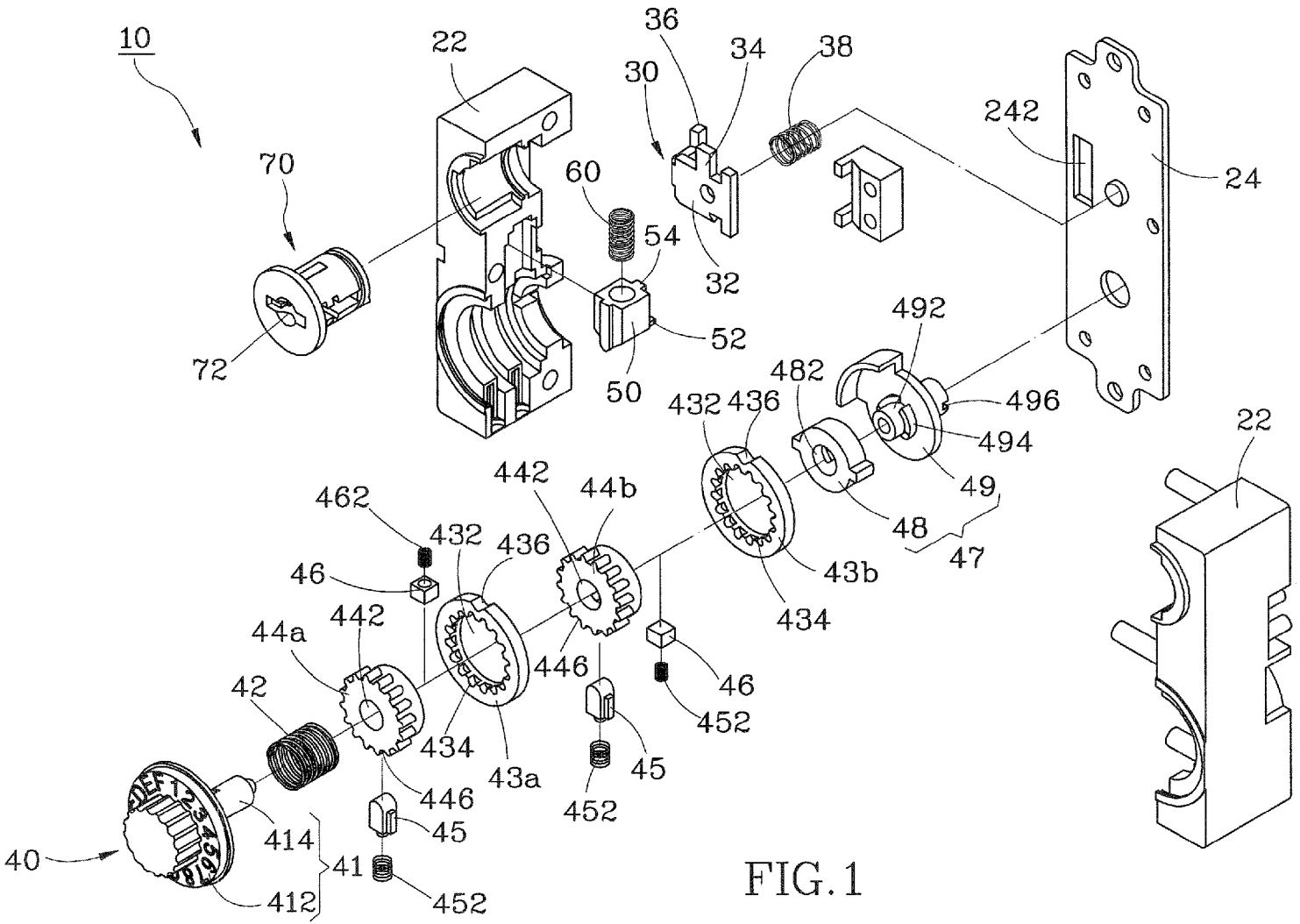
FIG. 1 is an exploded view of a combination-changeable complex lock according to the present invention.

Referring to FIG. 1, a combination-changeable complex lock 10 in accordance with the present invention is shown comprised of a casing, a movable plate 30, a combination lock 40, a sliding member 50, a spring member 60, and a pin tumbler lock 70.

The casing is comprised of two symmetrical cover shells 22 and a bottom plate 24. The cover shells 22 are abutted with against each other. The bottom plate 24 is affixed to bottom sides of the cover shells 22, having an elongated slot 242.

The movable plate 30 is mounted in the casing, having a base 32, an extension portion 34 horizontally extending outwards from the base 32, and a stop portion 36 perpendicularly extending outwards from the base 32. Further, a spring member 38 is stopped between the movable plate 30 and the bottom plate 24 for allowing the movable plate 30 to pivot among a first position, a second position, and a third position with respect to the casing.

Figure 2:
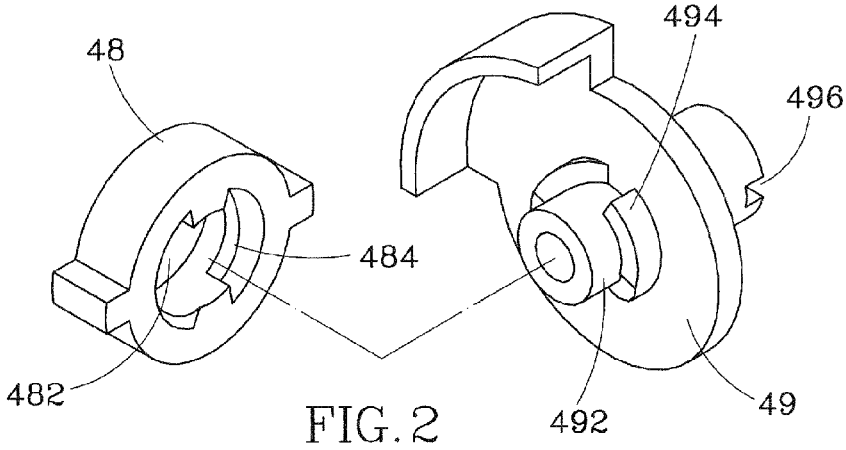
FIG. 2 is an exploded view of a part of the present invention, showing the relationship between the spiral sloping surface of the stop member and the spiral sloping surface of the rotating member.
Figure 3:
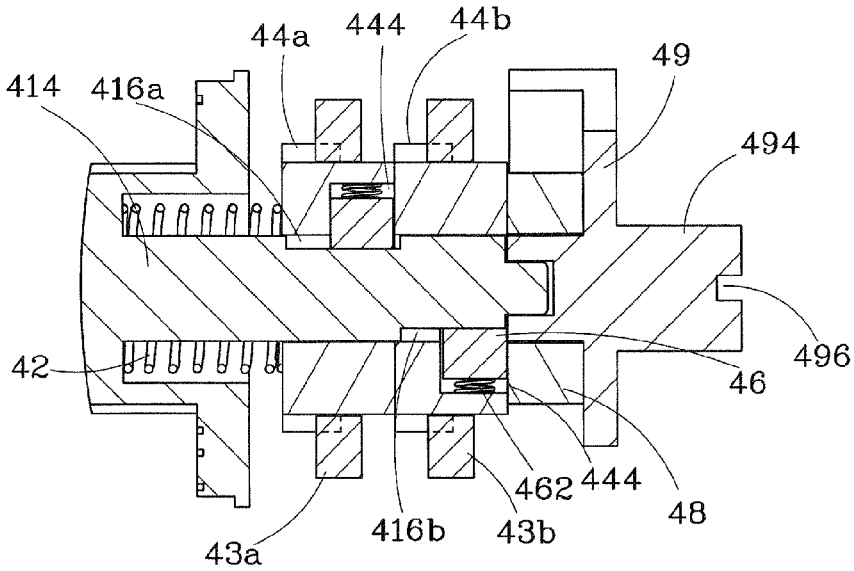
FIG. 3 is a sectional view of a part of the present invention before the predetermined combination is changed.
Figure 8:
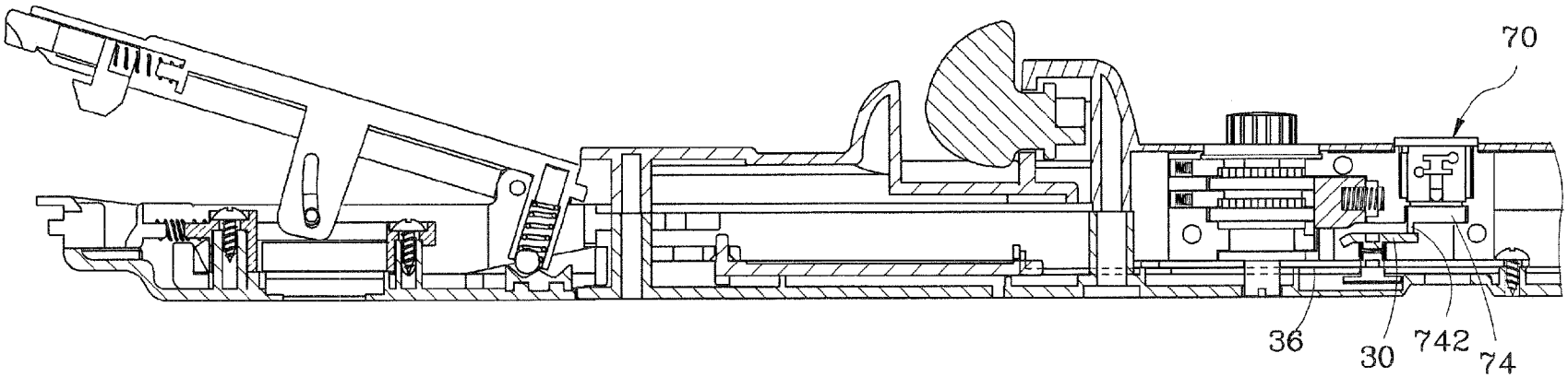
FIG. 8 is another sectional view of a part of the present invention, showing the movable plate is located at the third position.

The combination lock 40 includes a rotary knob 41, a spring member 42, two notched rotating discs 43*a* and 43*b*, two gearwheels 44*a* and 44*b*, two tooth members 45, two steering control members 46, and a combination-alteration control device 47. The rotary knob 41 includes a dial 412, and a shaft 414 perpendicularly extending outwards from a center of a bottom side of the dial 412. The dial 412 is located at a top side of the casing for dialing by the user. The shaft 414 is inserted into the casing, having two notches 416*a* and 416*b* at two opposite sides thereof. As illustrated in FIG. 3, the second notch 416*b* is located below the first notch 416*a*. The spring member 42 is sleeved onto the shaft 414 and stopped with its top end against the bottom side of the dial 412. The notched rotating discs 43*a* and 43*b* each have a center opening 432 for sleeved onto the shaft 414, an internal gear 434 formed around the opening 432, and a notch 436 formed on an outer periphery thereof. The gearwheels 44*a* and 44*b* each have a circular center through hole 442 for sleeved onto the shaft 414. The gearwheels 44*a* and 44*b* are respectively meshed with the internal gears 434 of the notched rotating discs 43*a* and 43*b*. One gearwheel 44*a* has its one side, namely, the top side stopped against the bottom end of the spring member 42, and its opposite side, namely, the bottom side stopped against the top side of the other gearwheel 44*b*. Further, the gearwheels 44*a* and 44*b* each have an inside notch 444 formed on an inner periphery of the circular center through hole 442, as shown in FIG. 3. The tooth members 45 are mounted inside the casing, and forced by a spring member 452 into engagement with tooth grooves 446 of the gearwheels 44*a* and 44*b* for enabling the gearwheels 44*a* and 44*b* to be rotated subject to the dial 412. The steering control members 46 are mounted in the inside notches 444 of the gearwheels 44*a* and 44*b*, and forced by a spring member 462 into engagement with the notches 416*a* and 416*b* of the shaft 414, as shown in FIG. 3. The notches 416*a* and 416*b* are located at two opposite sides of the shaft 414 respectively, each having an inclined surface (not shown) facing a direction converse to that of the other. By means of the notches 416*a* and 416*b*, the rotary knob 41 can drive clockwise or counter-clockwise rotation of the two gearwheels 44*a* and 44*b*. Because the notches 416*a* and 416*b* face toward converse directions, the gearwheels 44*a* and 44*b* can only be rotated in clockwise or counter-clockwise direction. The combination-alteration control device 47 is comprised of a stop member 48 and a rotating member 49. As shown in FIG. 2, the stop member 48 has a through hole 482 for sleeved onto the shaft 414 of the rotary knob 41 and stopped at a bottom side of the gearwheel 44*b*, and a spiral sloping surface 484 thereof inside the through hole 482. The rotating member 49 has a shank 492 inserted through the through hole 482 of the stop member 48, and a spiral sloping surface 494 formed on an outer periphery of a top end of the shank 492 and matching the spiral sloping surface 484 of the stop member 48, as shown in FIG. 8. A bottom end of the shank 492 is inserted through the bottom plate 24 out of the casing, having a tool groove 496 formed at a bottom end edge. The user can engage a tool into the tool groove 496 to rotate the rotating member 49.

The sliding member 50 is mounted inside the casing, having a stop flange 52 facing the combination lock 40 and a protruding portion 54 formed at a distal end of a bottom side thereof.

The spring member 60 is mounted inside the casing and stopped between one of the cover shells 22 and a distal end of the sliding member 50, for generating a resilience forcing the sliding member 50 toward the notched rotating discs 43*a* and 43*b*. When the combination lock 40 is unlocked, the two notches 436 are aligned and in communication with each other, and the stop flange 52 of the sliding member 50 is forced by the spring member 60 into engagement with the notches 436 of the notched rotating discs 43*a* and 43*b*. At this time, the movable member 30 is in the first position. When the combination lock 40 is locked, the two notches 436 are not aligned with each other, and the sliding member 50 is forced away from the notches 436 by the notched rotating discs 43*a* and 43*b* to compress the spring member 60 and to stop the protruding portion 54 against the movable plate 30, thus driving the movable plate 30 to pivot from the first position to the second position.

The pin tumbler lock 70 is mounted inside the casing, having a keyway 72 at a top side thereof and a bottom actuation member 74 extending from a bottom side thereof. The bottom actuating block 74 has a spiral sloping surface 742 (see FIG. 8). The pin tumbler lock 70 can be rotated with the key between a locking position and an unlocking position. When the key is inserted into the keyway 72 and rotated to open the pin tumbler lock 70, the bottom actuating block 74 is synchronously rotated with the key to force the spiral sloping surface 742 against the extension portion 34 of the movable plate 30, thereby enabling the movable plate 30 to pivot from the second position to the third position. When the pin tumbler lock 70 is located at the locked position, the spiral sloping surface 742 of the bottom actuating block 74 is separated from the extension portion 34 of the movable plate 30.

Figure 4:
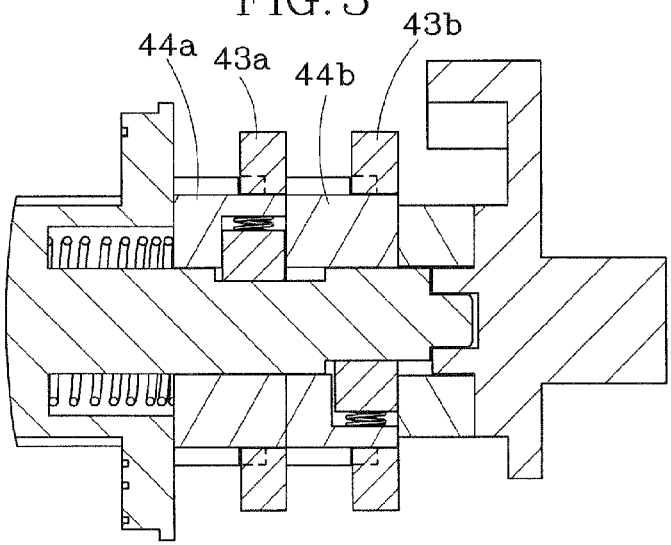
FIG. 4 is a sectional view of a part of the present invention after the predetermined combination is changed.

Referring to FIGS. 3 and 4, when intending to change the combination of the combination lock 40, the user can insert a hand tool into the tool groove 496 of the rotating member 49 and then rotate the rotating member 49 to force the spiral sloping surface 494 of the rotating member 49 against the spiral sloping surface 484 of the stop member 48, and to further force the stop member 48 to drive the two gearwheels 44*a* and 44*b* to move away from the internal gears 434 of the notched rotating discs 43*a* and 43*b*, as shown in FIG. 4. At this time, the notched rotating discs 43*a* and 43*b* will not be rotated together with the gearwheels 44*a* and 44*b*. And then, the user can turn the rotary knob 41 clockwise to drive rotation of the gearwheel 44*a* via the notch 416*b* until a predetermined mark (numeral) of the dial 412 is shown. At this time, the user can remove the hand tool from the tool groove 496 of the rotating member 49, such that the resilience of the spring member 42 pushes the two gearwheels 44*a* and 44*b* into engagement with the internal gears 434 of the notched rotating discs 43*a* and 43*b* again. Thus, the alteration of the combination is done.

Figure 5:
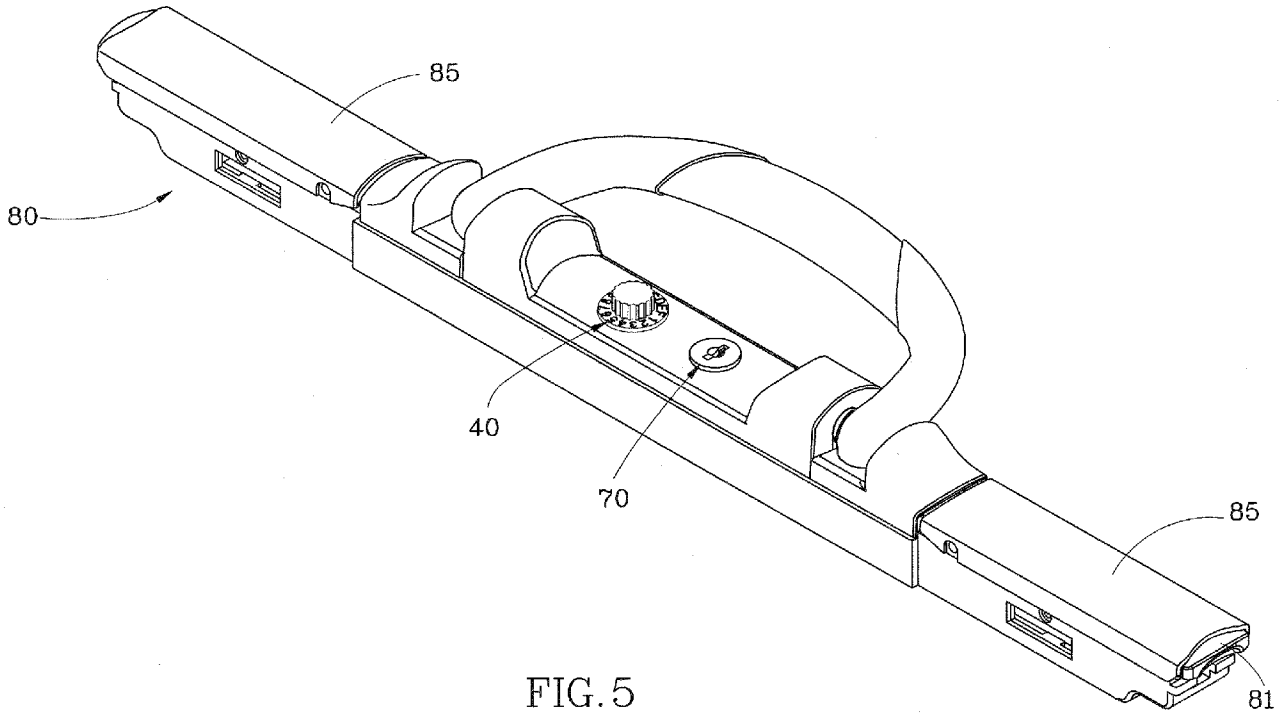
FIG. 5 is a perspective view of the present invention applied to a suitcase lock.

FIG. 5 illustrates the complex lock of the present invention used in a suitcase lock 80. The detailed structure of the suitcase lock 80 is of the known design, so that no further detailed description in this regard is necessary.

Figure 6:
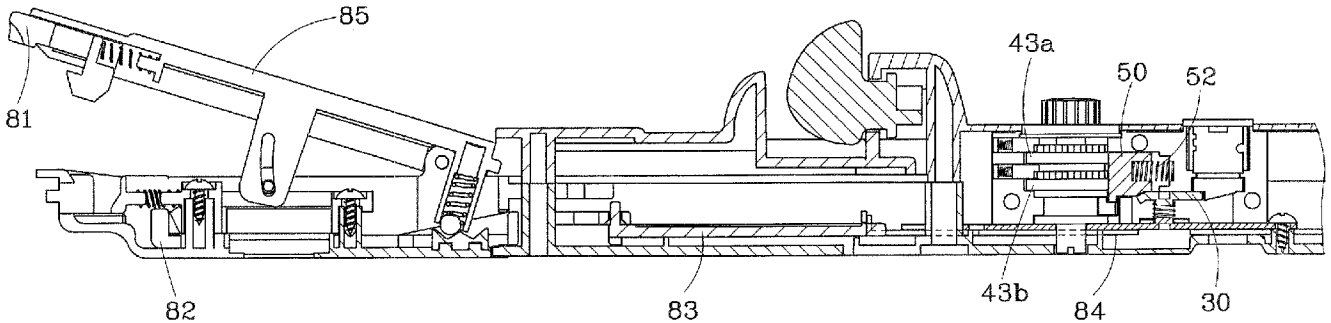
FIG. 6 is a sectional view of a part of the present invention, showing that the movable plate is located at the first position.

When intending to open the suitcase through the combination lock 40, the user can turn the dial 412 clockwise to one particular numeral to drive the notch 436 of the notched rotating disc 43*a* into engagement with the stop flange 52 of the sliding member 50, and then the user can turn the dial 412 counterclockwise to another particular numeral to drive the notch 436 of the other notched rotating disc 43*b* into engagement with the stop flange 52 of the sliding member 50. Thus, the spring member 52 pushes the sliding member 50 toward the two notched rotating discs 43*a* and 43*b*, further forcing the movable plate 30 to move to the first position (see FIG. 6). At this time, the combination lock 40 is unlocked, and the user can push the push blocks 81 to move the corresponding first links 82, further moving the corresponding second and third links 83 and 84. In light of this, the user can push the push blocks 81 to enable the associating locking caps 85 to pivot upwards to further unlock the suitcase lock 80.

Figure 7:
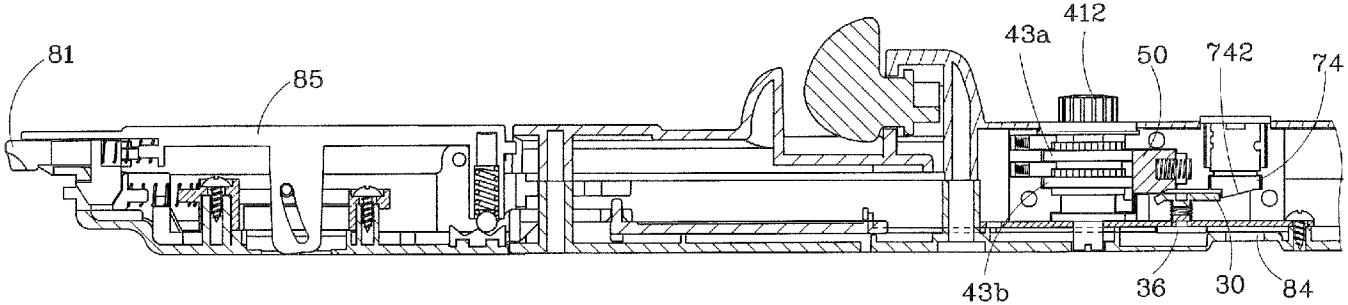
FIG. 7 is another sectional view of a part of the present invention, showing the movable plate is located at the second position.

When the user rotates the dial 412 arbitrarily to separate the notches 436 of the notched rotating discs 43*a* and 43*b* away from the stop flange 52 of the sliding member 50 after the locking caps 85 is closed, the sliding member 50 will be forced by the two notched rotating discs 43*a* and 43*b* to lie against the movable plate 30 to lower the movable plate 30 from the first position to the second position, as shown in FIG. 7, thus locking the combination lock 40. At this time, the stop portion 36 of the movable plate 30 stops front ends of the third links 84, prohibiting the linking mechanisms from movement driven by the push blocks 81. Therefore, pushing the push blocks 81 at this time cannot enable upward pivoting movement of the locking caps 85 to open the suitcase lock 80.

Referring to FIG. 8, if the user forgets the correct combination of the combination lock 40, the user can insert the key into the keyway 72 of the pin tumbler lock 70 and rotate the key to enable the spiral sloping surface 742 of the bottom actuating block 74 to lie against the extension portion 34 of the movable plate 30, thereby lowering the movable plate 30 from the second position to the third position, and therefore the suitcase lock 80 is opened.

Figure 9:
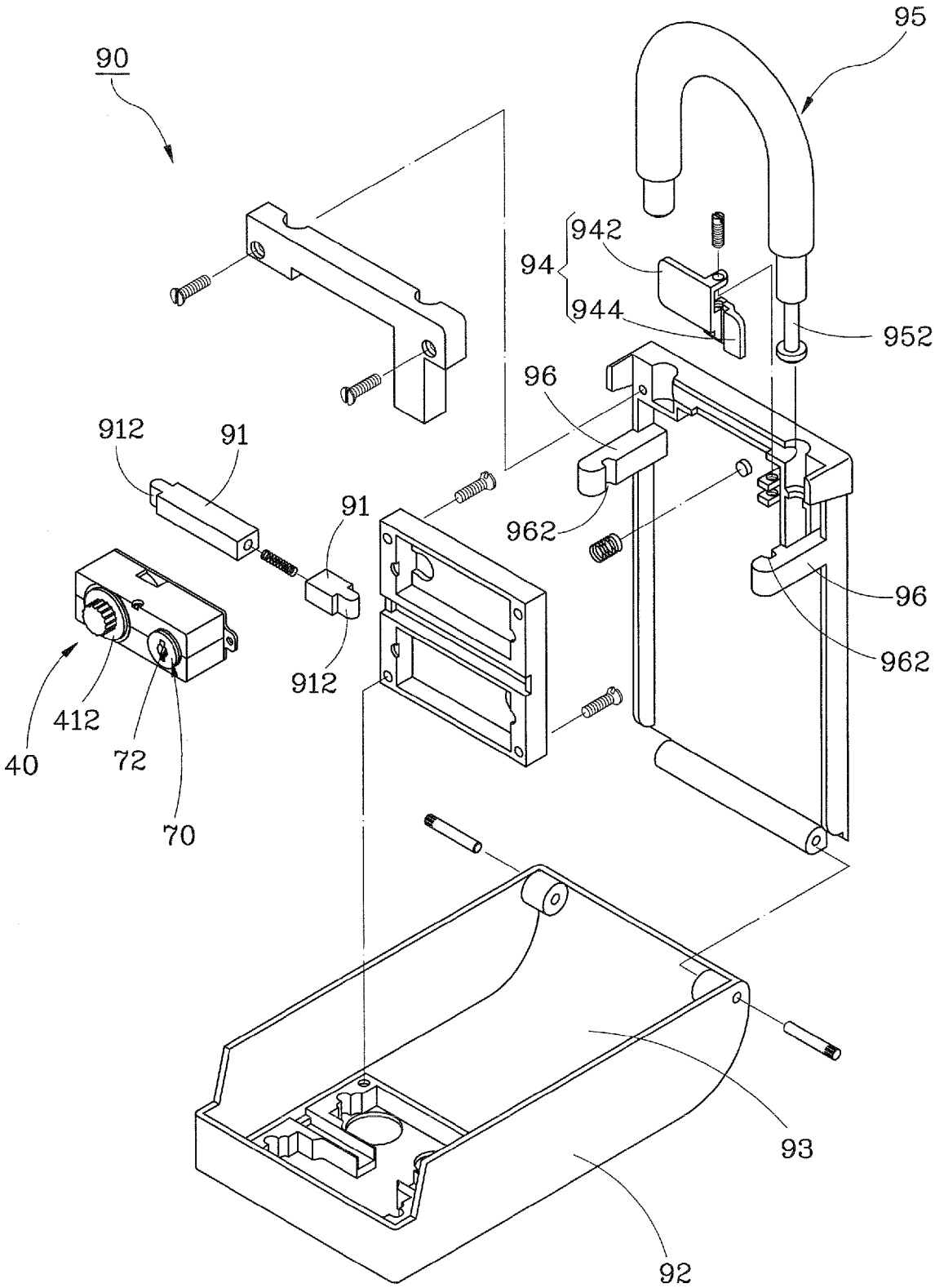
FIG. 9 is an exploded view of the present invention applied to a padlock.

FIG. 9 illustrates that the invention is used in a padlock 90. The detailed structure of the padlock 90 is of the known design, so that no further detailed description in this regard is necessary.

Figure 10:
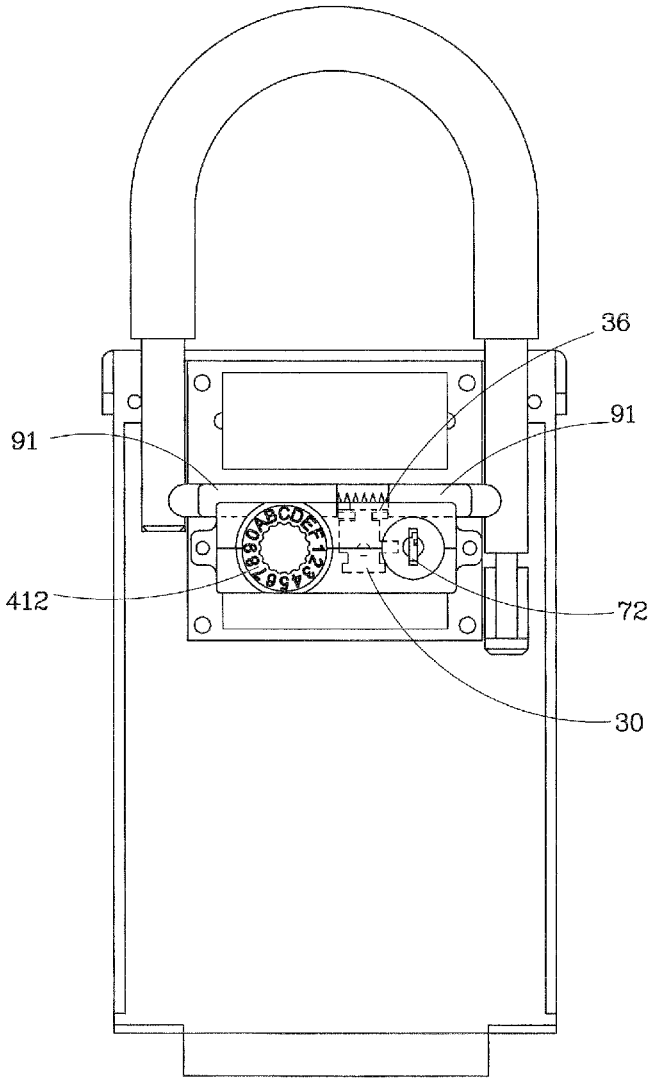
FIG. 10 is a sectional view of the padlock shown in FIG. 9.

Referring to FIG. 10, when the padlock 90 is used, the user can turn the dial 412 to the correct combination first. At this time, the movable plate 30 is biased relative to the two latches 91 to the first position and disengaged from the rear ends of the latches 91, allowing the user to pull a cover 92 of the padlock 90 outward, thereby opening an accommodation chamber 93 of the padlock 90. Next, the user can press finger strip 942 of a control member 94 to disengage the engagement portion 944 of the control member 94 from the neck 952 of the shackle 95, thereby opening the shackle 95. Thus, the user can fasten the padlock 90 to an article and keep a memo or small item in the accommodation chamber 93. And then, the user can close the cover 92 and turn the dial 412 to bias the movable plate 30 to the second position in between the rear ends of the two latches 91. At this time, tongues 912 of the latches 91 are respectively engaged into retaining notches 962 of corresponding retaining rods 96 to lock the cover 92.

If the user forgets the correct combination of the combination lock 40, the user can insert the key into the keyway 72 of the pin tumbler lock 70 and rotate the key to enable the spiral sloping surface 742 of the bottom actuating block 74 to lie against the extension portion 34 of the movable plate 30, thereby biasing the movable plate 30 from the second position to the third position to separate the stop portion 36 of the movable plate 30 away from the rear ends of the latches 91, allowing the user to open the cover 92.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A combination-changeable complex lock comprising:

a casing;

a movable plate pivotally mounted to said casing;

a combination lock mounted in said casing, said combination lock having a rotary knob, said rotary knob having a shaft, two notched rotating discs sleeved onto the shaft of said rotary knob, said notched rotating discs each having a peripheral notch, two gearwheels sleeved onto said shaft of said rotary knob and meshed with said notched rotating discs, a spring member sleeved onto said shaft of said rotary knob, one of said two gearwheels contacting against said spring member, and a combination-alteration control device rotatably mounted to said shaft of said rotary knob and stopped against the other of said two gearwheels; and a sliding member movably mounted to said casing, said sliding member engaging the peripheral notches of said notched rotating discs when said combination lock is unlocked, said sliding member being moved away from said peripheral notches of said notched rotating discs to push against said movable plate when said combination lock is locked.

2. The combination-changeable complex lock as claimed in claim 1, wherein said combination-alteration control device comprises a stop member and a rotating member, said stop member having a through hole and a first spiral sloping surface formed at the through hole, said rotating member having a shank inserted through the through hole of said stop member and a second spiral sloping surface formed on an outer periphery of said shank, said second spiral sloping surface matching the first spiral sloping surface.

3. The combination-changeable complex lock as claimed in claim 1, wherein said combination lock further comprises two tooth members mounted inside said casing and engaged with said gearwheels, and two steering control members mounted to said gearwheels for engaging said shaft of said rotary knob.

4. The combination-changeable complex lock as claimed in claim 3, wherein said shaft of said rotary knob comprises two notches formed at two opposite sides at different elevations; said gearwheels each have an inside notch corresponding to the notches of said shaft of said rotary knob; said steering control members are mounted to the inside notches of said gearwheels and stopped against the notches of said shaft of said rotary knob.

5. The combination-changeable complex lock as claimed in claim 1, wherein said combination-alteration control device comprises a tool groove at a bottom end thereof.

6. The combination-changeable complex lock as claimed in claim 1, further comprising a pin tumbler lock mounted to said casing for rotation between a locking position and an unlocking position, said pin tumbler lock having an actuating block, said actuating block being stopped against said movable plate when said pin tumbler lock is located at said unlocking position, said actuating block being separated from said movable plate when said pin tumbler lock is located at said locking position.

7. The combination-changeable complex lock as claimed in claim 6, wherein said movable plate has an extension portion, said actuating block of said pin tumbler lock has a sloping surface, the sloping surface of said actuating block being stopped against said extension portion of said movable plate when said pin tumbler lock is located at said unlocking position, the sloping surface of said actuating block being separated from said extension portion of said movable plate when said pin tumbler lock is located at said locking position.

8. The combination-changeable complex lock as claimed in claim 1, further comprising a spring member mounted between said casing and said sliding member.

9. The combination-changeable complex lock as claimed in claim 1, wherein said sliding member comprises a stop flange for engaging or disengaging the peripheral notches of said notched rotating discs.

* * * * *